US007092656B2

(12) United States Patent
Yokokawa

(10) Patent No.: US 7,092,656 B2
(45) Date of Patent: Aug. 15, 2006

(54) DEVELOPING APPARATUS AND IMAGE-FORMING APPARATUS

(75) Inventor: Kazuki Yokokawa, Ibaraki (JP)

(73) Assignee: Canon Finetech Inc., Ibaraki (JP)

( * ) Notice: Subject to any disclaimer, the term of this patent is extended or adjusted under 35 U.S.C. 154(b) by 0 days.

(21) Appl. No.: 10/717,298

(22) Filed: Nov. 19, 2003

(65) Prior Publication Data

US 2004/0218945 A1 Nov. 4, 2004

(30) Foreign Application Priority Data

Nov. 21, 2002 (JP) ..... 2002-337569

(51) Int. Cl.
*G03G 15/08* (2006.01)

(52) U.S. Cl. ..... 399/104

(58) Field of Classification Search ..... 399/91, 399/98, 102, 103, 104, 105, 106, 99, 111
See application file for complete search history.

(56) References Cited

U.S. PATENT DOCUMENTS 5,267,003 A * 11/1993 Grappiolo ..... 399/109
5,978,623 A * 11/1999 Itoh ..... 399/104
6,038,414 A * 3/2000 Inami et al. ..... 399/104

* cited by examiner

*Primary Examiner*—Hoan Tran
(74) *Attorney, Agent, or Firm*—Dellett & Walters patenttm.us

(57) ABSTRACT

A developing apparatus prevents magnetic toner rise on the peripheral face of the developing sleeve to avoid scatter of magnetic toner even when a gap is caused between the developing blade and the magnetic sealing member. A magnetic plate of a base part and a protruding part, where the base has a rectangular cross-section and is in the shape of an arc extends along the peripheral face of a developing sleeve. The protruding part is on the upstream side of a doctor blade in the rotation direction in the middle of the base part in the arc length direction. The protruding part protrudes nearly perpendicularly from the side face which is perpendicular to the peripheral face of the developing sleeve, so as to cover the regions of the peripheral face of the developing sleeve from the base part to the portion facing the doctor blade.

17 Claims, 11 Drawing Sheets

DEVELOPING APPARATUS AND IMAGE-FORMING APPARATUS

The present invention relates to a developing apparatus for forming a developed image by feeding a developing agent onto an electrostatic latent image formed on an image-bearing member, and relates also to an imageforming apparatus incorporating the developing apparatus.

BACKGROUND OF THE INVENTION

As an output apparatus for computers and work stations, electrophotographic image-forming apparatuses are known which form an image on a recording medium by using a powdery developing agent (toner). Such an image-forming apparatus is equipped with an image-bearing member like a photosensitive drum on which an electrostatic latent image is formed, and a developing apparatus for supplying a developing agent onto the electrostatic latent image formed on the photosensitive drum.

A conventional developing apparatus is explained below by reference to FIGS. 10 and 11.

FIG. 10 is a schematic drawing showing an example of conventional developing apparatus. FIG. 11 is a front view of a developing apparatus provided with a conventional magnetic sealing member.

The developing apparatus 10 is equipped with a toner container (developing agent container) 12 for holding a magnetic developing agent (hereinafter referred to as "magnetic toner T"), a stirring member 14 for delivering the magnetic toner T with stirring, and a roll-shaped (cylindrical) developing sleeve (developing-agent holder) 16 for holding the magnetic toner T delivered by the stirring member 14 on the peripheral face thereof. The developing apparatus 10 is further equipped with a developing blade 18 for controlling the thickness of the toner held on the peripheral face of the developing sleeve 16 as desired, and a magnetic sealing member 20 for preventing leakage of the magnetic toner T from the toner container 12.

The aforementioned toner container 12 is capable of containing a certain amount of the magnetic toner T. The stirring member 14 is fixed rotatably to the toner container 12, and rotates in the arrow A direction, thereby stirring and loosening the magnetic toner T mechanically and delivering the magnetic toner T smoothly to the developing sleeve 16 to be held thereon.

The developing sleeve 16 is fixed rotatably to bearings (not shown in the drawing) provided on the both sidewalls of the toner container 12. In the hollow in the developing sleeve 16, a magnetic roller 22 is fixed coaxially with the developing sleeve 16. The magnetic roller 22 is magnetized symmetrically to have plural magnetic poles (magnetic poles: N1, S1, N2, and S2) along the periphery direction. Thus, the developing sleeve 16 holds the magnetic toner T by the magnetic force of the magnetic poles N1, S1, N2, and S2, and delivers the magnetic toner smoothly onto an image-bearing member (not shown in the drawing).

The developing blade 18 is placed with a prescribed clearance to the peripheral face of the developing sleeve 16 to hold the toner T in a uniform thickness on the peripheral face of the developing sleeve 16.

The magnetic sealing member 20 is placed at respective ends of the developing sleeve 16 in the length direction (rotation axis direction) at a prescribed interval in a shape of an arc to prevent leakage of the toner T through a gap at the bearing portion (hereinafter called "sealing").

In a known technique of prevention of leakage of the magnetic toner T through the gap at the bearing portion, an elastic sealing member composed of an elastic material like a felt or a foamed rubber is pressed against the peripheral face at the respective lengthwise ends of the developing sleeve 16 to stop the gaps.

However, with this technique of using an elastic sealing member, the peripheral speed of the developing sleeve 16 can be made irregular by counteraction to the rotation torque by friction between the elastic sealing member and the developing sleeve 16. This irregularity or variation of the peripheral speed may impair the uniformity of toner holding ability of the developing sleeve 16. The lack of uniformity in the toner holding ability may cause non-conformation of the density of the toner image formed on the image-bearing member surface with the image information of the original document to lower the quality of the image formed on a recording medium like a recording sheet.

Therefore, to prevent the lowering of the image quality by use of the elastic sealing member, the aforementioned magnetic sealing member 20 is employed.

The magnetic sealing member 20 is an arc-shaped magnetic body placed near the peripheral face of the developing sleeve 16 with a prescribed gap (0.2–0.8 mm). Thereby a magnetic circuit is formed from by the magnetic sealing member 20 and the magnetic roller 22 in the developing sleeve 16. This magnetic circuit forms a magnetic brush of the developing agent. This magnetic brush prevents the leakage of the developing agent. The magnetic sealing member 20 is placed outside each of the lengthwise ends of the developing blade 18 as shown in FIG. 11.

SUMMARY OF THE INVENTION

In the above constitution, dimensional variation may arise in the magnetic sealing member 20, the developing blade 18, and the toner container 12 fixing the developing blade 18. This dimensional variation may cause a gap between the developing blade 18 and magnetic sealing member 20. In such an undesired formed gap, the magnetic toner T is not controlled by the developing blade 18 or the magnetic sealing member 20. Therefore in such a gap, the magnetic toner adhering to the peripheral face of the developing sleeve 16 comes to rise up to scatter outside, disadvantageously.

To overcome the above disadvantage, the present invention intends to provide a developing apparatus which prevents rise of the magnetic toner on the peripheral face of the developing sleeve not to cause scattering of the magnetic toner even when a gap is caused between the developing blade and the magnetic sealing member, and intends also to provide an image-forming apparatus employing this developing apparatus.

The developing apparatus of the present invention for attaining the above object is equipped with a developingagent holder in a cylinder shape rotating in a prescribed direction for holding a developing agent on the peripheral face thereof; a developing agent-controlling member extending in the length direction of the developing-agent holder in opposition thereto and controlling the developing agent held on the peripheral face of the developing agent holder to be in a prescribed thickness; and a magnetic plate extending in an arc shape along the peripheral face of the developing-agent holder in a region outside the lengthwise end of the developing agent-controlling member; for developing a latent image by feeding a developing agent from the developing-agent holder to the image-bearing member bearing a latent image thereon, wherein (1) the magnetic plate has a covering part for covering a portion of the peripheral face of the developing agentholder in a range from the magnetic plate to the region opposing the developing agent-controlling member.

The covering part may be (2) a protruding part protruding from a portion of a face of the magnetic plate opposing the developing agentcontrolling member.

The covering part may be (3) placed at the upstream side of the developing agentcontrolling member in the rotation direction of the developing-agent holder.

The covering part may be (4) placed at the downstream side of the developing agent-controlling member in the rotation direction of the developing-agent holder.

(5) The developing agent-controlling member may be an elastic body, serving to control the developing agent to be in a prescribed thickness by pressure-contact with the peripheral face of the developing-agent holder; and (6) the covering part may cover a portion of the developing-agent holder ranging from the upstream side of the developing agent-controlling member in the rotation direction of the developing agent holder to the region above the press-contact of the peripheral face of the developing agent-controlling member with the developing-agent holder.

The covering part may be (7) apart more from the peripheral face of the developingagent holder than the other portion of the magnetic plate.

The covering part may have a slanting face which slants from the upstream side to the downstream side in the rotation direction of the developing-agent holder toward the inside of the developing-agent holder and along the peripheral face.

The image-forming apparatus of the present invention for achieving the aforementioned object is (9) employs the above-mentioned developing apparatus for forming an image by developing an electrostatic latent image with the developing apparatus.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE SEVERAL VIEWS OF THE DRAWINGS

The mode for carrying out the present invention is described by reference to drawings.

DETAILED DESCRIPTION OF THE INVENTION

Figure 1:
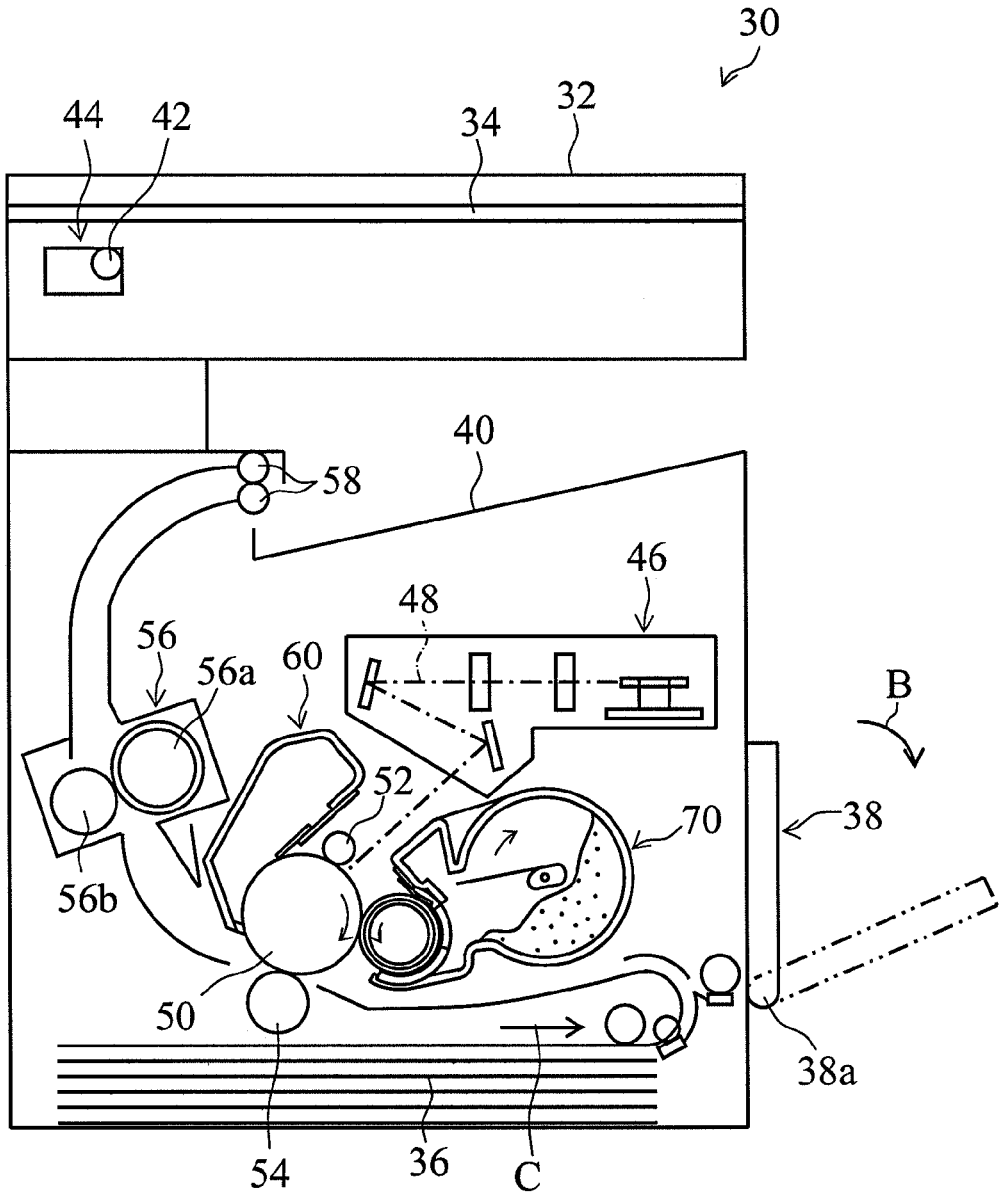
FIG. 1 is a schematic drawing of an internal structure of a copying machine as an example of the image forming apparatus incorporating the developing apparatus of the present invention.

FIG. 1 is a schematic drawing showing an internal structure of a copying machine which is an example of the image-forming apparatus employing the developing apparatus of the present invention.

An original document cover plate 32 is provided openably on the top face of the copying machine 30. A document-supporting glass plate 34 is provided under the cover plate 32 for supporting an original document (not shown in the drawing). A control panel (not shown in the drawing) is provided at the front side of the top face for inputting operation conditions such as a number of coping sheets. The copying machine 30 is equipped with a universal cassette 36 for holding cut sheets to be drawable from the main: body of the copying machine 30. A rectangleshaped manual feeding tray 38 is provided on the right-side panel of the copying machine 30 to feed small-sized recording paper sheets such as postcards. This manual feeding tray 38 is turnable around the lower side 38*a* thereof in the arrow B direction to the position for placing the recording medium (to the position shown by a two-dot chain line. A discharged sheet-receiving tray 40 is provided in the upper portion of the copying machine 30 for receiving recording sheets after image formation.

The procedure of image formation with the copying machine 30 is explained below.

An original document is placed on the top face of document-supporting glass plate 34 with the image face downward, and is fixed by a document cover plate 32. An image on the original document is read by a conventional type of optical system 44 having a light source lamp 42 or the like to obtain light carrying the image information regarding the image recorded on the original document. This light information is transformed into electric signals by an electronic signal transformer (not shown in the drawing), and is sent to a conventional laser irradiation device 45. The laser beam 48 (one-dot chain line C) is projected to a photosensitive drum 50 at a laser irradiation timing in correspondence with the electric signals. The photosensitive drum 50 is electrified uniformly by an electrifying roller 52. The projection of the laser beam 48 onto the photosensitive drum 50 forms electrostatic latent image on the photosensitive drum 50. This electrostatic latent image is developed into a Developed image by a developing agent fed from a developing apparatus 70.

On the other hand, a recording medium like a recording paper sheet is fed from a universal cassette 36 in the arrow C direction (feed direction). The developed image is transferred by a transfer roller 54 onto the recording medium. The recording medium having received the developed image is delivered to a fixing unit 56. The fixing unit 56 is provided with a heating roller 56*a* and a pressing roller 56*b*. The recording medium is pinched and delivered thereto by the two rollers 56*a*, 56*b*, whereby the developed image is fixed onto the recording medium. The recording medium carrying the fixed image is discharged by a pair of discharging rollers 58 onto a discharged paper tray 40. After the image transfer, the toner remaining on the photosensitive drum 50 is scraped off by a cleaning unit 60. The recording medium can alternatively be fed from a manual feeding tray 38. The image formation procedure after the manual feeding is the same as described above.

The copying machine 30 incorporates various parts and members as described above. Of the parts incorporated, the electrifying roller 52, the photosensitive drum 50, the cleaning unit 60, and the developing apparatus 70 constitute a process cartridge in integration. This process cartridge is mounted demountably in the copying machine 30.

The developing apparatus 70 constituting the process cartridge is explained below by reference to FIG. 2.

Figure 2:
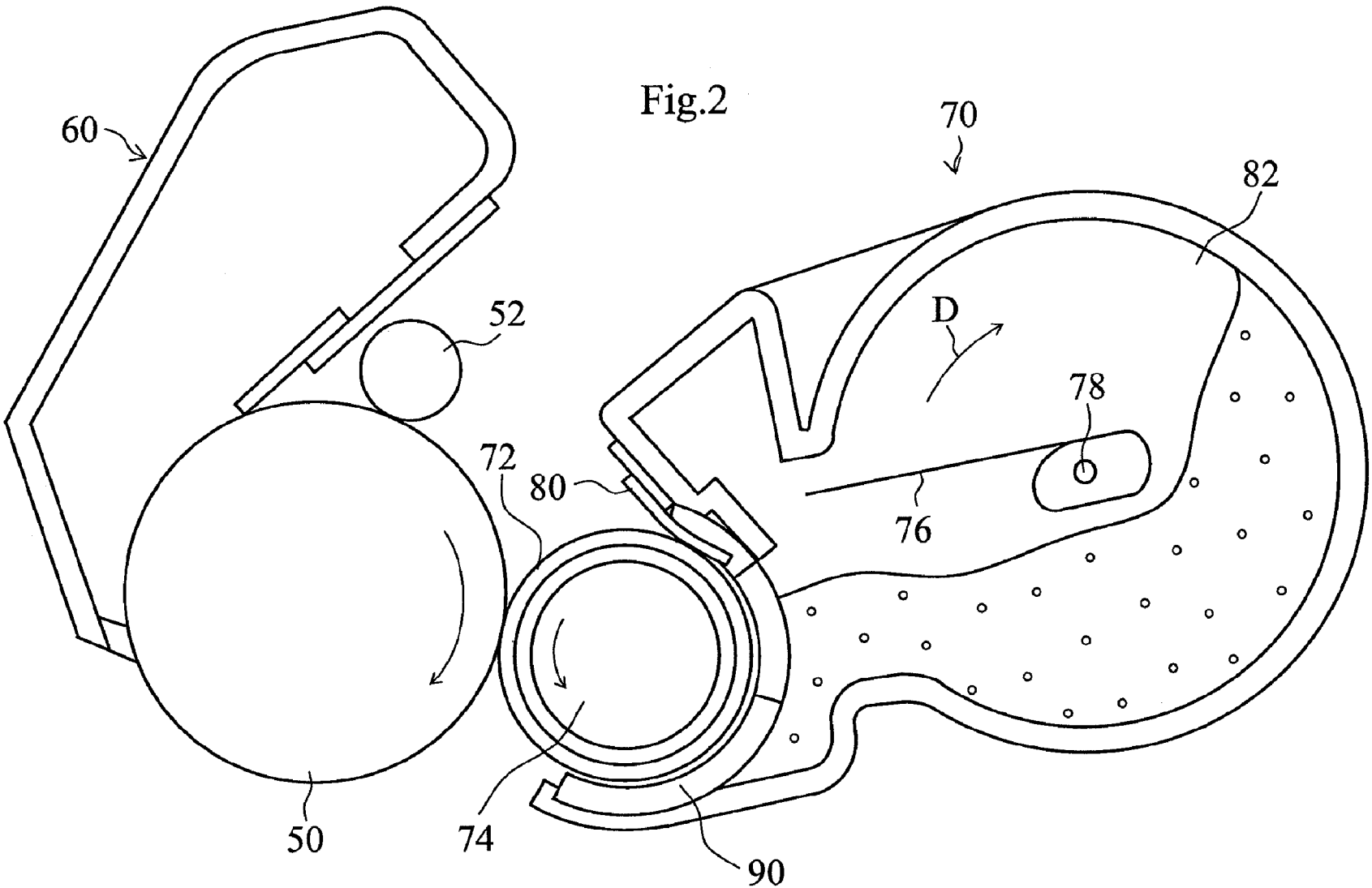
FIG. 2 is a schematic drawing of a process cartridge.

FIG. 2 is a schematic drawing of a process cartridge. In FIG. 2, the same symbols as in FIG. 1 are used for corresponding constitution elements.

The developing apparatus 70 has a developing sleeve 72 (also called a developing roller, an example of the developing agent carrier). A bias voltage which is a superposition of a DC voltage and an AC voltage is applied from a bias power source (not shown in drawing) to the developing sleeve 72. The development sleeve 72 and the magnet roller 74 therein allow the developing agent to form ears and to adhere onto the surface of the developing sleeve 72 to feed the developing agent to the photosensitive drum 50.

A developing agent container 82 for holding the magnetic toner T is provided on the side of the developing sleeve 72 opposite to the photosensitive drum 50. Inside the developing agent container 82, a developing agent stirrer 76 is provided. The developing agent stirrer 76 rotates in the arrow D direction around a center axis 78, whereby the magnetic toner T is delivered with stirring to the developing sleeve 72. A doctor blade 80 (developing agent controlling member of the present invention) is provided fixedly near the developing sleeve 72 to control the height (thickness) of the developing agent ears formed on the surface of the developing sleeve 72.

This doctor blade 80 serves to push a part of the magnetic toner. T having delivered to the developing sleeve 72 back to the developing agent container 82. Thereby the height of the developing agent delivered onto the surface of the developing sleeve 72 is controlled to be a prescribed level. The developing agent in a prescribed height is fed with the rotation of the developing sleeve 72 to the photosensitive drum 50.

A magnetic plate 90 in a shape of an arc is provided along the peripheral face of the developing sleeve 72 near the respective lengthwise ends outside the doctor blade 80 (directed perpendicular to the drawing sheet plane in FIG. 2). The shape and other properties of the magnetic plate 90 is described later The magnetic plate 90 forms a magnetic circuit with the magnetic roller 74. This magnetic circuit allows the developing agent to form a magnetic brush. This magnetic brush prevents leakage of the magnetic toner T at the both lengthwise end portions of developing sleeve 72.

Figure 4:
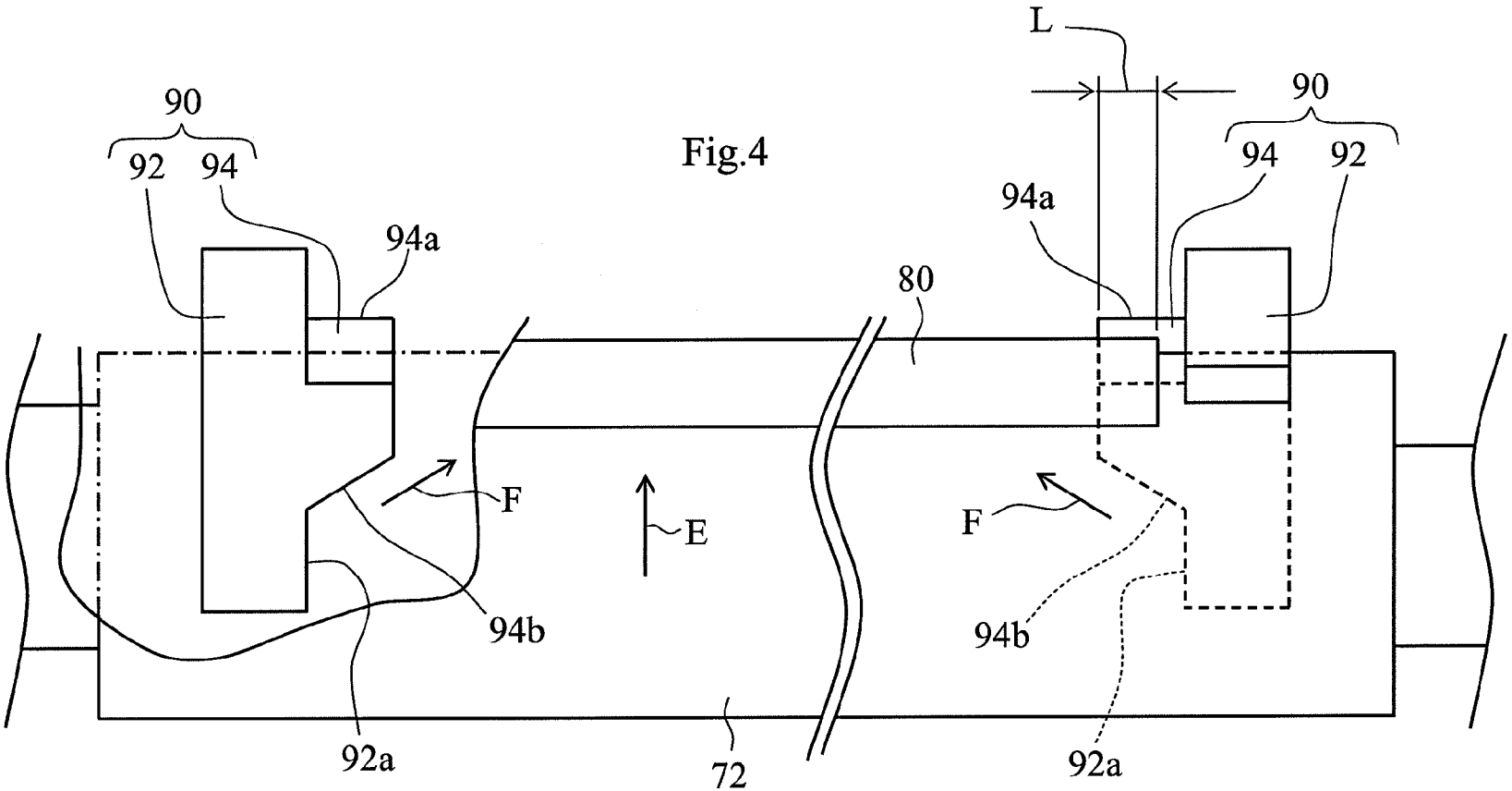
FIG. 4 is a plan view showing schematically the positional relations of a magnetic blade, a doctor blade, and a developing sleeve.
Figure 5:
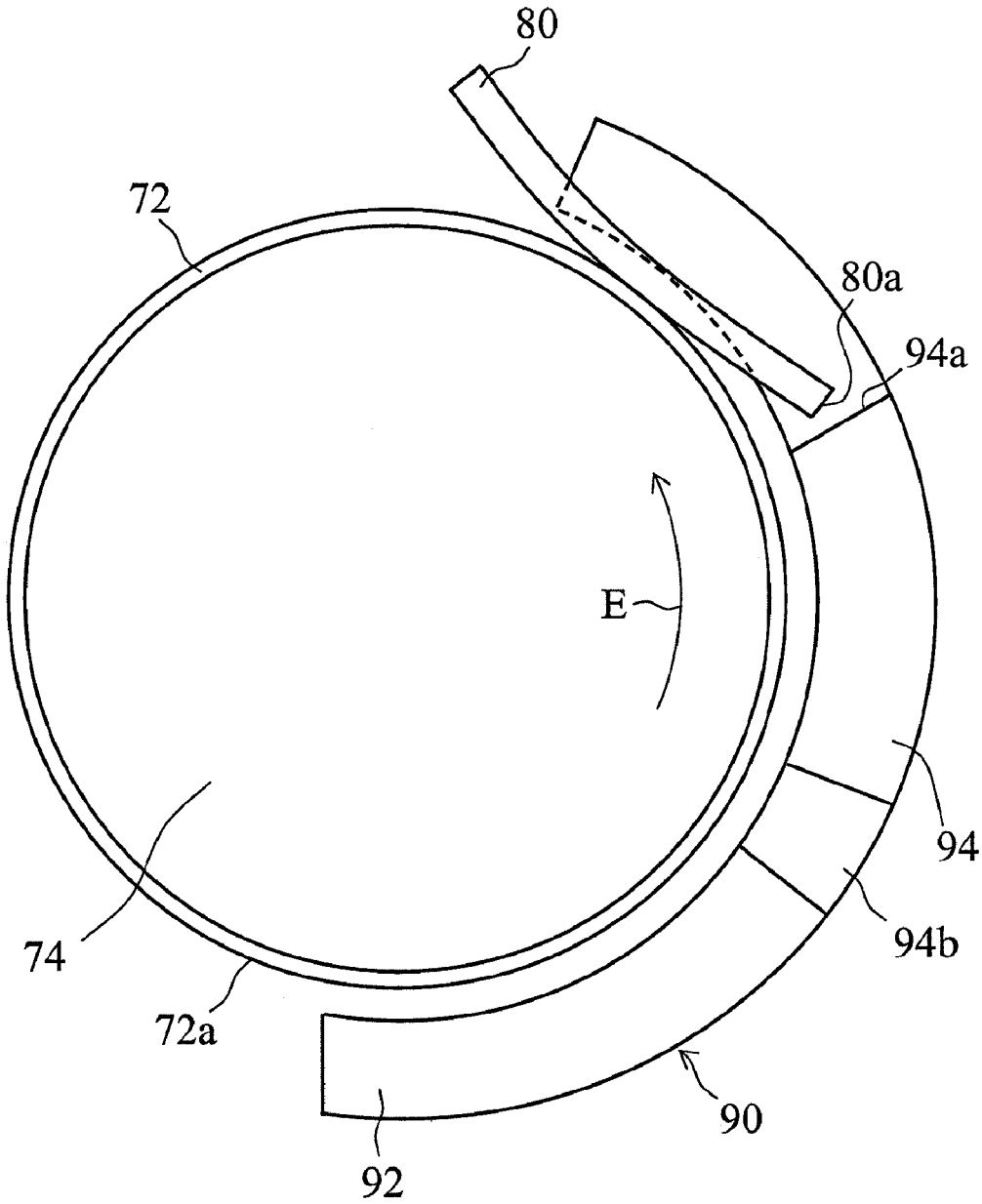
FIG. 5 is a side view of a magnetic plate.

The magnetic plate 90 is explained below by reference to FIGS. 3–5.

Figure 3:
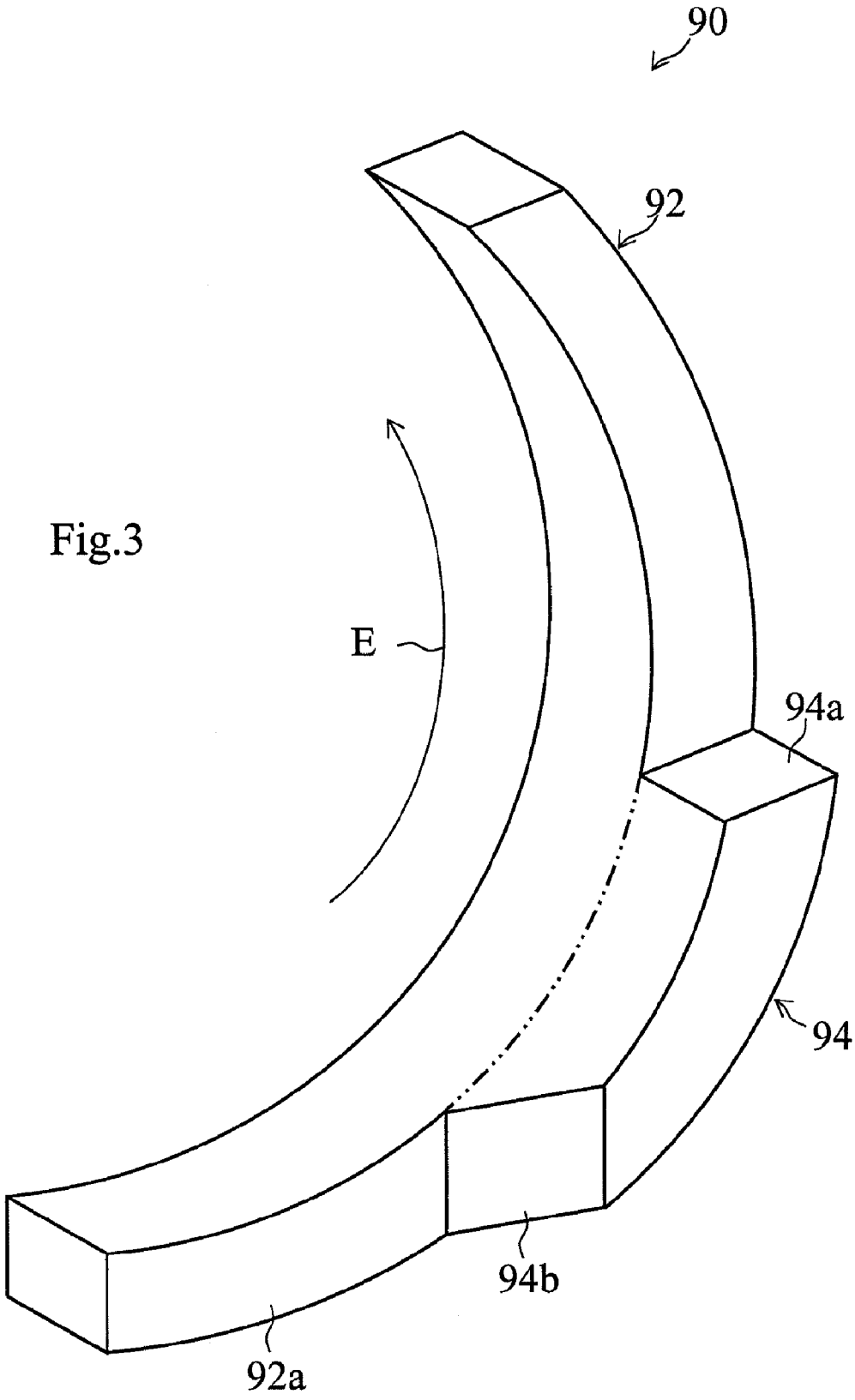
FIG. 3 is a perspective view of a magnetic plate.

FIG. 3 is a perspective view of the magnetic plate. FIG. 4 is a schematic plan view showing positional relations of the magnetic plate, the doctor blade, and the developing sleeve. FIG. 5 is a lateral view of the magnetic plate. In these drawings, the same symbols as in FIG. 2 are used to indicate the corresponding constitution member.

The magnetic plate 90 is constituted of a base part 92 having a rectangular cross-section and a protruding part 94 protruding from the base part 92. The base part 92 is in a shape of an arc extending along the peripheral face 72*a* of the developing sleeve 72, and is placed along the peripheral face 72*a* (of the developing sleeve 72) about halfway around with a certain clearance (about 0.3 mm) to the peripheral face 72*a* of the developing sleeve 72.

The protruding part 94 is formed in the lengthwise middle portion (in arc direction) of base part 92, and is placed on the upstream side of the doctor blade 80 (arrow E direction side) in the rotation direction of the developing sleeve 72, and is in a shape of an arc shorter than the base part 92. The protruding part 94 protrudes nearly perpendicularly from the side face 92*a* (of the base part 92) which is perpendicular to the peripheral face 72*a* of the developing sleeve 72. In other words, the protruding part 94 protrudes nearly perpendicularly from the face (side face 92*a*) confronting the doctor blade 80.

The protruding part 94 protrudes in the direction from the one lengthwise end of the developing sleeve 72 at the side of the base part 92 toward the other end thereof. The protruding part 94 protrudes so as to cover the regions of the peripheral face 72*a* of the developing sleeve 72 ranging from the base part 92 to the portion facing the doctor blade 80. Therefore, a portion of the gap caused between the base part 92 and the doctor blade 80 is covered by the protruding part 94. That is, the protruding part 94 protrudes from the base part 92 toward the contacting portion (development region) where the doctor blade 80 is brought into contact with the peripheral face of the developing sleeve 72, extending to (overlapping with) the development region by about 4 mm (distance L in FIG. 4).

The end face 94*a* of the protruding part 94 at the rotationally downstream side of the developing sleeve 72 (arrow E direction) is placed at nearly the same position as the end face 80*a* of the doctor blade 80. The other end face 94*b* of the protruding part 94 at the rotationally upstream side of the developing sleeve 72 (arrow E direction) is slanted toward the development region in a direction from the upstream side to the downstream side of the rotation direction (arrow F direction). The magnetic plate 90 is placed on the respective lengthwise end sides of the doctor blade 80.

A magnetic brush is formed by the magnetic roller 74 and the protruding part 94 of the magnetic plate 90 even when a gap is caused between the end of the doctor blade 80 in the length direction and the base part 92. This controls the magnetic toner T held by developing sleeve 72 not to rise up in this gap. Therefore, scatter of the magnetic toner T is prevented at the both lengthwise ends of the developing sleeve 72. Since the end face 94*b* of the protruding part 94 is slanted as mentioned above toward the development region in the direction from the upstream side to the downstream side of the rotation direction of the developing sleeve 72, the magnetic toner T forming the magnetic brush is returned suitably into the developing apparatus 70 (arrow F direction). As the result, the magnetic toner T in the gap between the doctor blade 80 and the magnetic plate 90 is cycled suitably.

Another example of the magnetic plate is explained below by reference to FIG. 6.

Figure 6:
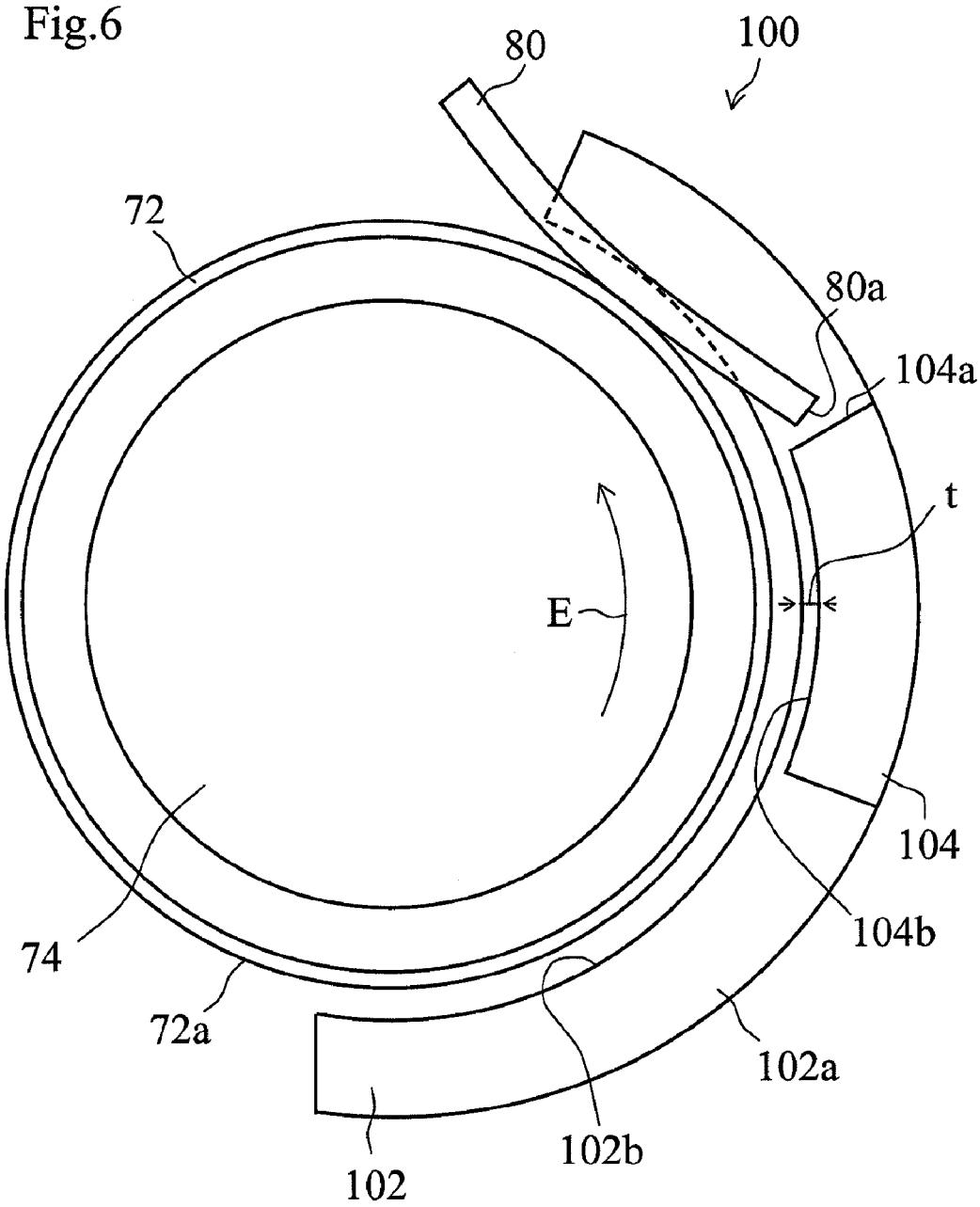
FIG. 6 is a side view of another magnetic plate.

FIG. 6 is a side view of a magnetic plate of another example. In this drawing, the same symbols as in FIG. 2 are used to indicate corresponding members.

The magnetic plate 100 is constituted of a base part 102 having a rectangular cross-section and a protruding part 104 protruding from the base part 102. The base part 102 is in a shape of an arc extending along the peripheral face 72*a* of the developing sleeve 72, and is placed along the peripheral face 72*a* about halfway around with a certain clearance (about 0.3 mm) to the peripheral face 72*a* of the developing sleeve 72. Therefore, the face (inside peripheral face) 102*b* of the base part 102 facing the developing sleeve 72 is about 0.3 mm apart uniformly from the peripheral face 72*a* of the developing sleeve 72.

The protruding part 104 is formed in the lengthwise middle portion of the base part 102 (in arc direction), and placed on the upstream side of the doctor blade 80 in the rotation direction (arrow E direction) of developing sleeve 72; and is in a shape of an arc shorter than the base part 102. The inside peripheral face 104*b* (of the protruding part 104) confronting the development sleeve 72 is about 0.1 mm apart more (distance "t" in FIG. 6) than the inside peripheral face 102*b* of the base part 102 from the outside peripheral face 72*a* of the developing sleeve 72. That is, the inside face 104*b* of the protruding part 104 is about 0.4 mm apart from the outside face 72*a* of the developing sleeve 72.

The protruding part 104 protrudes nearly perpendicularly from the side face 102*a* (of the base part 102) which is perpendicular to the peripheral face 72*a* of the developing sleeve 72. In other words, the protruding part 104 protrudes nearly perpendicularly to the face (side face 102*a*) confronting the doctor blade 80.

The protruding part 104 protrudes in the lengthwise direction of the developing sleeve 72 from the one end where the base part 102 is placed toward the other end. The protruding part 104 protrudes so as to cover the regions of the peripheral face 72*a* of the developing sleeve 72 ranging from the base part 102 to the portion facing the doctor blade 80. Therefore, a portion of the gap caused between the base part 102 and the doctor blade 80 is covered by the protruding part 104. That is, the protruding part 104 protrudes from the base part 102 toward the contacting portion (development region) where the doctor blade 80 is brought into contact with the peripheral face of the developing sleeve 72, entering (overlapping with) the development region by about 4 mm (distance T, in FIG. 4).

The end face 104*a* of the protruding part 104 at the downstream side in the rotation direction of the developing sleeve 72 (arrow E direction) is placed at nearly the same position as the end face 80*a* of the doctor blade 80. The magnetic plate 90 is placed on the respective lengthwise end sides of the doctor blade 80.

A magnetic brush is formed by the magnetic roller 74 and the protruding part 104 of the magnetic plate 100 even when a gap is caused between the end of the doctor blade 80 in the length direction and the base part 102. The formed magnetic brush controls the magnetic toner T held by developing sleeve 72 not to rise up in this gap. Therefore, scattering of the magnetic toner T is prevented at the both lengthwise ends of the developing sleeve 72. Since the inside peripheral face 104*b* of the protruding part 104 is about 0.1 mm more apart than the inside peripheral face 102*b* of the base part 102 from the outside peripheral face 72*a* of the developing sleeve 72, the magnetic toner T controlled by the doctor blade 80 is not excessively used for the magnetic brush formation on the outside peripheral face 72*a*. Therefore, in the region of outside peripheral face covered by the protruding part 104, the amount of the magnetic toner T does not become extremely less. Thus the magnetic toner T will not cause sticking which can be caused by rubbing with the doctor blade 80 in a state of extremely insufficient amount of the magnetic toner T.

A still another example of the magnetic plate is explained by reference to FIG. 7.

Figure 7:
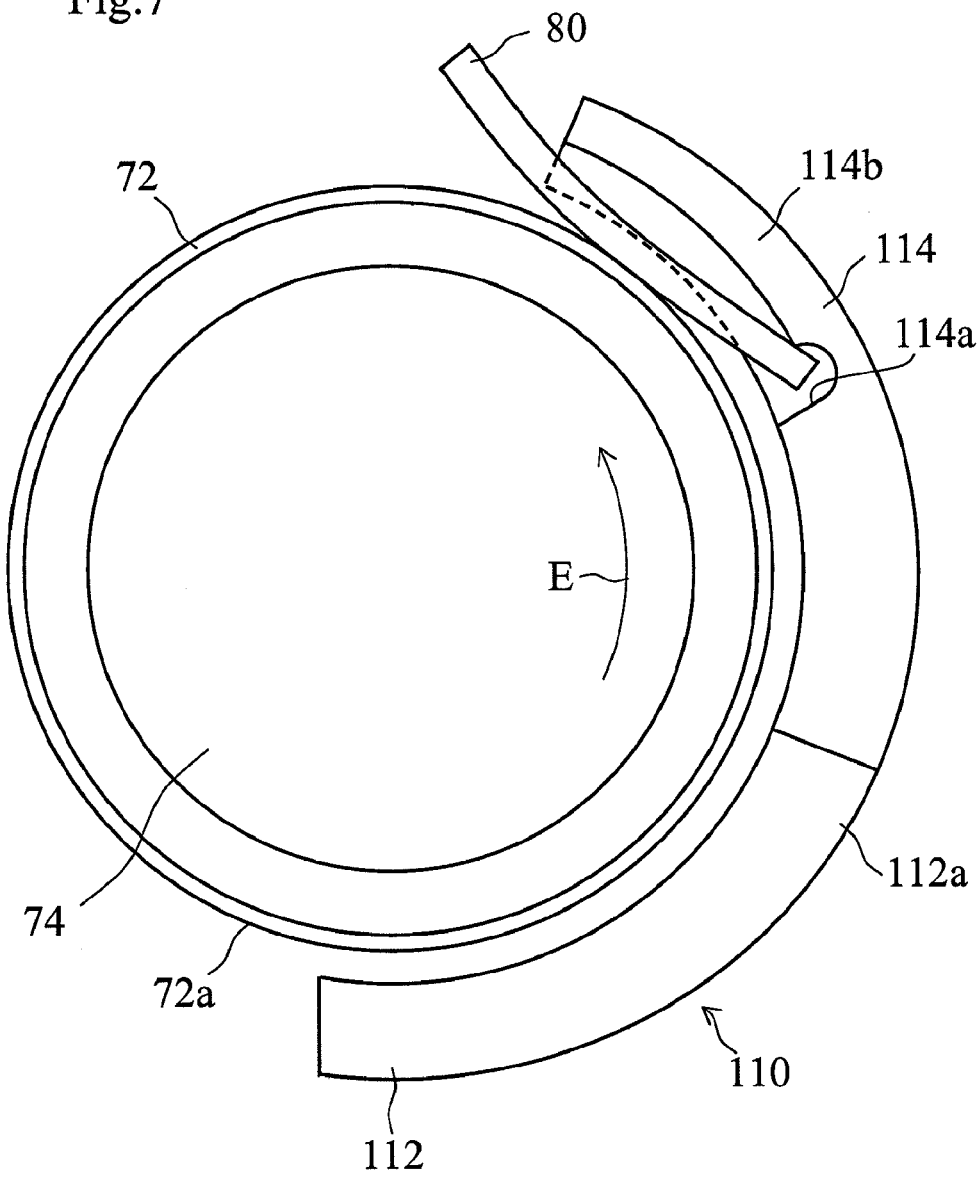
FIG. 7 is a side view of still another magnetic plate.

FIG. 7 is a side view of a magnetic plate of another example. In this drawing, the same symbols as in FIG. 2 are used to indicate corresponding elements.

The magnetic plate 110 is constituted of a base part 112 having a rectangular cross-section and a protruding part 114 protruding from the base part 112. The base part 112 is in a shape of an arc extending along the peripheral face 72*a* of the developing sleeve 72. The base part 112 is placed along the peripheral face 72*a* of the development sleeve 72 about halfway around with a certain clearance (about 0.3 mm) to the peripheral face 72*a* of the developing sleeve 72.

The protrusion portion 114 is formed in the range from the lengthwise middle portion of the base part 112 (arc direction) to the rotationally downstream side of the developing sleeve 72, and is in a shape of an arc shorter than the base part 11.2. The protruding part 114 protrudes nearly perpendicularly from the side face 112*a* (of the base part 112) which is perpendicular to the peripheral face 72*a* of the developing sleeve 72. In other words, the protruding part 114 protrudes nearly perpendicularly from the face (side face 112*a*) confronting the doctor blade 80.

The protruding part 114 protrudes in the lengthwise direction of the developing sleeve 72 from the one end where the base part 112 is placed toward the other end. The protruding part 114 protrudes so as to cover the regions of the outside peripheral face 72*a* of the developing sleeve 72 ranging from the base part 112 to the region facing the doctor blade 80. Therefore, a portion of the gap caused between the base part 112 and the doctor blade 80 is covered by the protruding part 114. That is, the protruding part 114 protrudes from the base part 112 toward the contacting portion (development region) where the doctor blade 80 is brought into contact with the peripheral face of the developing sleeve 72, entering (overlapping with) the development region by about 4 mm (distance E in FIG. 4).

The end face 114*a* of the protruding part 114 on the downstream side (arrow E direction) of the developing sleeve 72 is formed at nearly the same position as the end face 80*a* of the doctor blade 80. The protruding part 114 is extended (lengthened) further from the end face 114*a* in the downstream direction (arrow E direction). The doctor blade 80 is constituted of an elastic body, serving to control the developing agent to be in a prescribed thickness by pressing the elastic body against the peripheral face 72*a* of the developing sleeve 72. The protruding part 114 covers the range from the upstream side of the doctor blade 80 in the rotation direction (arrow E direction) of the developing sleeve 72 to the above of the position where the doctor blade 80 is in pressure-contact with the peripheral face 72*a* of the developing sleeve 72.

The magnetic plate 110 has the protruding part 114. A magnetic brush is formed by the magnetic roller 74 and the protruding part 114 even when a gap is caused between the lengthwise end of the doctor blade 80 and the base part 112. The formed magnetic brush controls the magnetic toner T held by developing sleeve 72 not to rise up in this gap. Therefore, scatter of the magnetic toner T is prevented at the both lengthwise ends of the developing sleeve 72. In the gap caused between the protruding part 114 and the doctor blade 80, a magnetic brush is formed invariably by the magnetic roller 74 and the protruding part 114. Thereby, the leakage of the magnetic toner T at the lengthwise ends of the developing sleeve 72 is more surely prevented.

A still another example of the magnetic plate is explained by reference to FIGS. 8 and 9.

Figure 8:
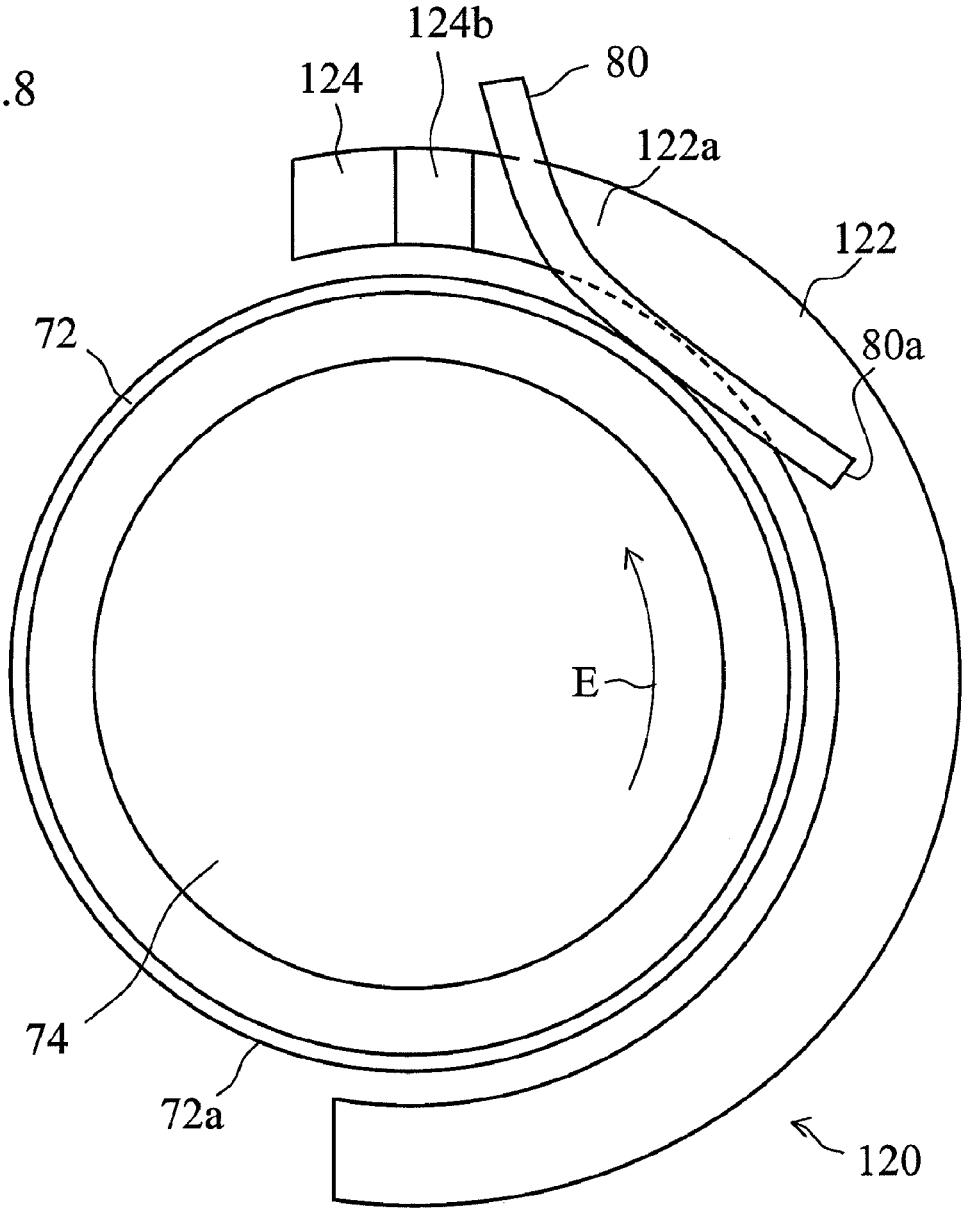
FIG. 8 is a side view of still another magnetic plate.
Figure 9:
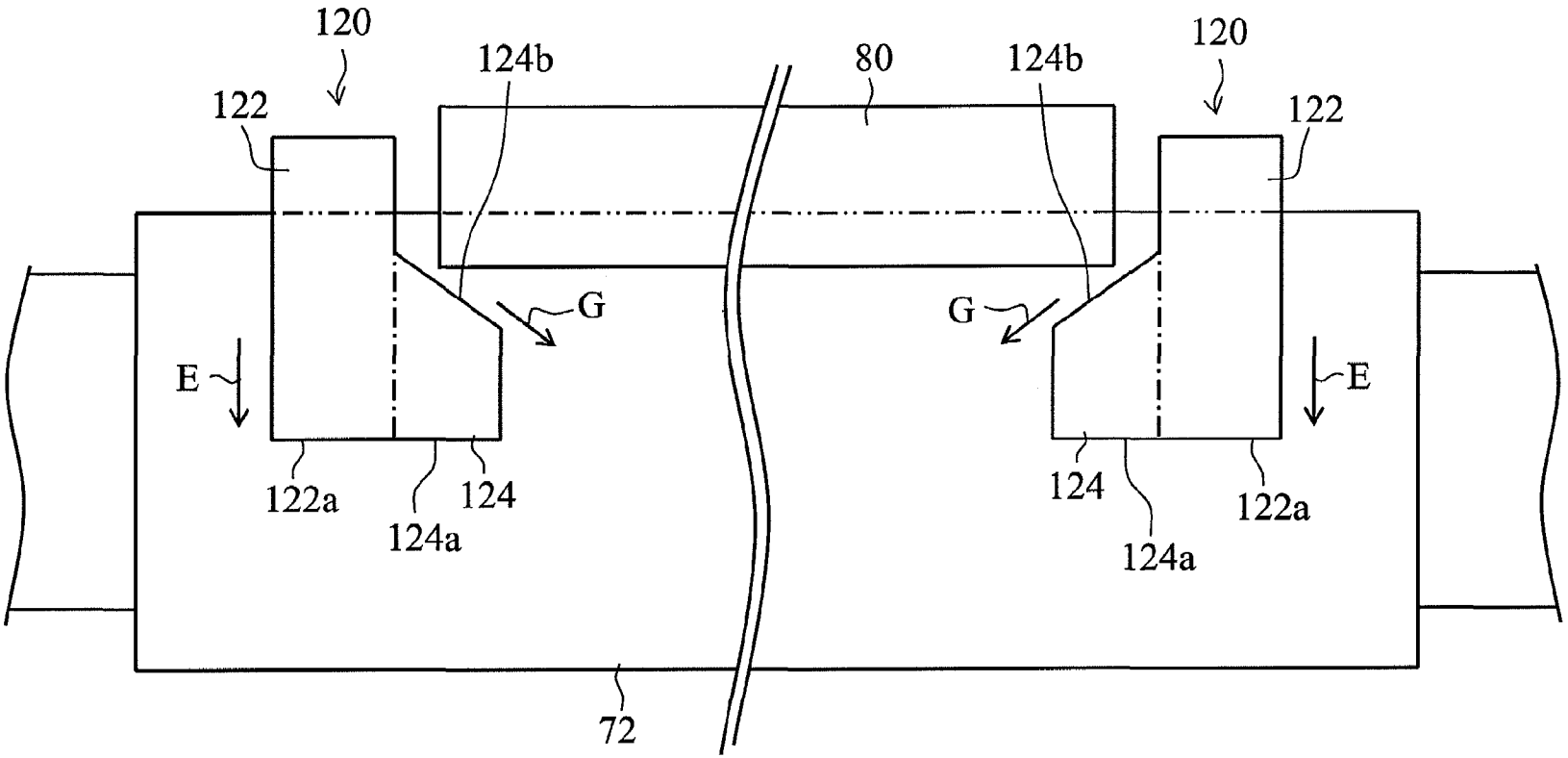
FIG. 9 is a plan view showing schematically the positional relations of a magnetic blade, a doctor blade, and a developing sleeve.
Figure 10:
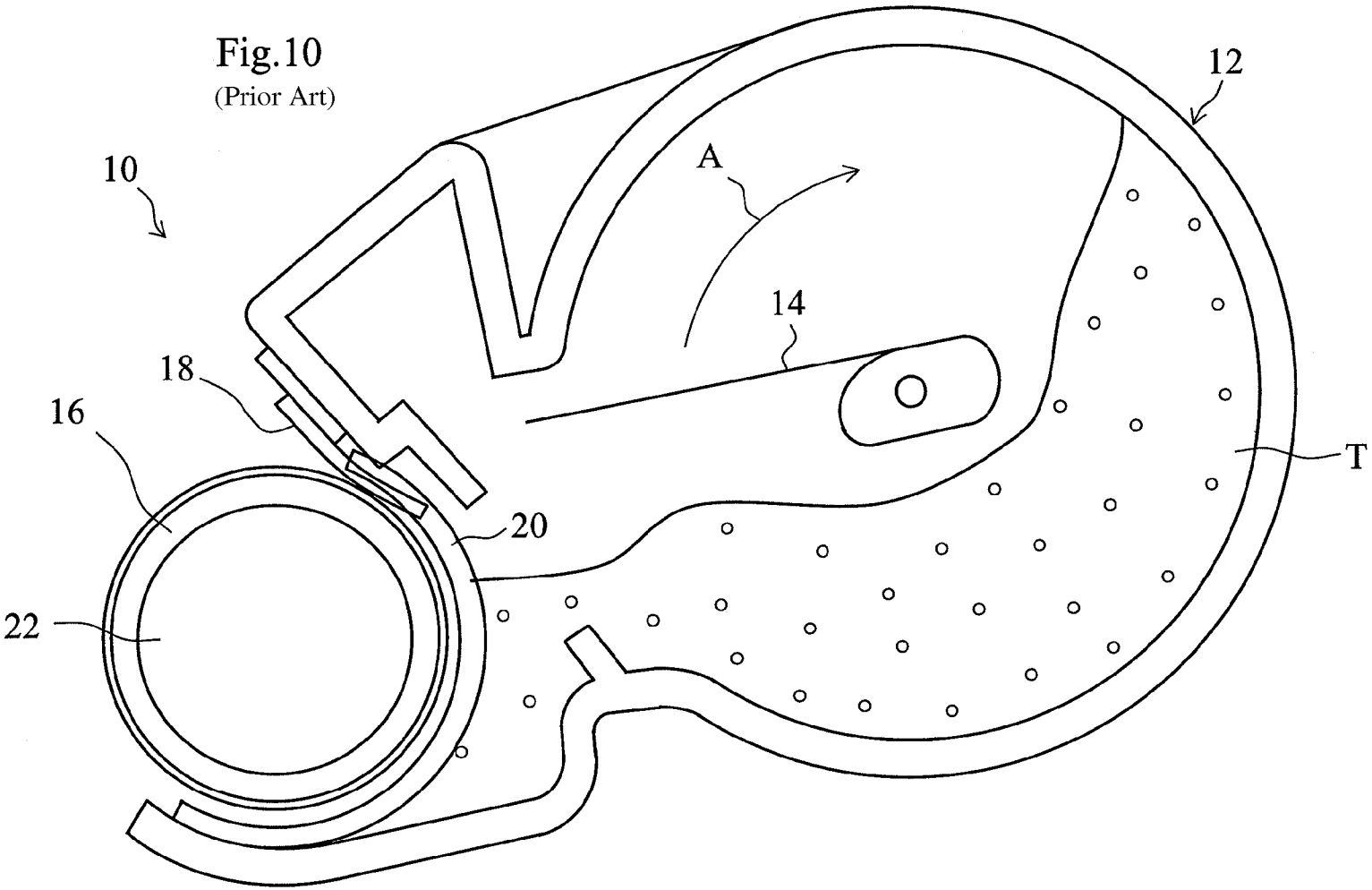
Fig.10 (Prior Art)
FIG. 10 is a schematic drawing of a conventional developing apparatus.
Figure 11:
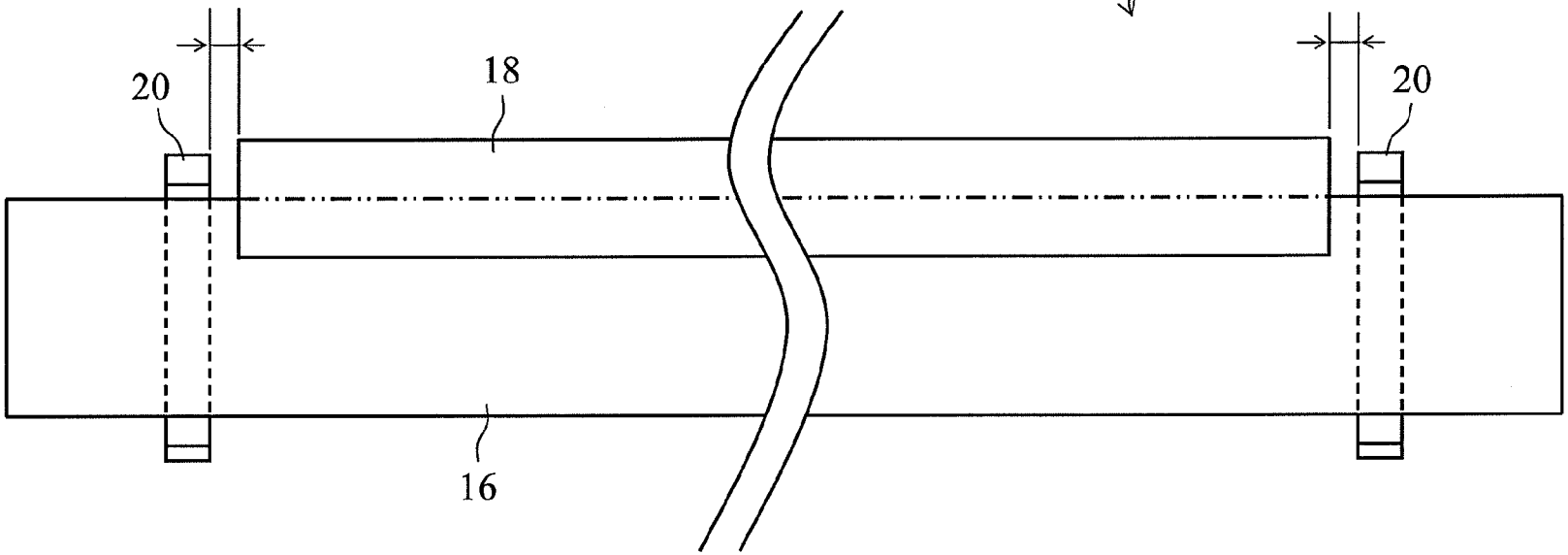
Fig.11 (Prior Art)
FIG. 11 is a front view of a developing apparatus equipped with a conventional magnetic sealing member.

FIG. 8 is a side view of a magnetic plate of another example. FIG. 9 is a plan view showing schematically the positional relations of a magnetic plate, a doctor blade, and a developing sleeve. In these drawings, the same symbols as in FIG. 2 are used to indicate corresponding elements.

The magnetic plate 120 is constituted of a base part 122 having a rectangular cross-section and a protruding part 124 protruding from the base part 122. The base part 122 is in a shape of an arc extending along the peripheral face 72*a* of the developing sleeve 72. The base part 122 is placed along the peripheral face 72*a* of the developing sleeve 72 about halfway around with a certain clearance (about 0.3 mm) to the peripheral face 72*a* of the developing sleeve 72.

The protruding part 124 is formed on the end of the base part 122 in the length direction (arc direction) in a trapezoid shape above the downstream side of the doctor blade 80 (arrow E direction) in the rotation direction of the developing sleeve 72. The protruding part 124 protrudes nearly perpendicularly from the side face 122*a* (of the base part 122) which is perpendicular to the peripheral face 72*a* of the developing sleeve 72. In other words, the protruding part 124 protrudes nearly perpendicularly from the face (side face 122*a*) confronting the doctor blade 80.

The protruding part 124 protrudes in the direction of the length of the developing sleeve 72 from the end of the sleeve at the side of the base part 122 toward the other end of the sleeve. The protruding part 124 protrudes so as to cover the regions of the peripheral face 72*a* of the developing sleeve 72 ranging from the base part 122 to the portion facing the doctor blade 80. Therefore, a part of the gap caused between the base part 122 and the doctor blade 80 is covered by the protruding part 124. That is, the protruding part 124 protrudes from the base part 122 toward the contacting portion (development region) where the doctor blade 80 is in contact with the peripheral face of the developing sleeve 72, entering (overlapping with) the development region by about 4 mm (distance L in FIG. 4).

The end face 124*a* of the protruding part 124 at the rotationally upstream side (arrow E direction) of the developing sleeve 72 is placed at nearly the same position as the end face 122*a* of the base part 122. The end face 124*b* of the protruding part 124 at the rotationally upstream side (arrow E direction) of the developing sleeve 72 is slanted so as to enter the development region from the upstream side to the downstream side of the rotation (in arrow G direction). The magnetic plate 120 is provided on each of the ends in the length direction of the doctor blade 80.

Since the magnetic plate 120 has the protruding part 124, a magnetic brush is formed by the magnetic roller 74 and the protruding part 124 even when a gap is caused between the lengthwise end of the doctor blade 80 and the base part 122. The formed magnetic brush controls the magnetic toner T held by developing sleeve 72 not to rise up in this gap. Therefore, scatter of the magnetic toner T is prevented at the both lengthwise ends of the developing sleeve 72. Further, the end face 124*b* of the protruding part 124 is slanted, as mentioned above, to enter the development region from the upstream side to the downstream side of the rotation direction of the developing sleeve 72. Therefore the magnetic toner T forming the magnetic brush is suitably returned into the developing apparatus 70 (in arrow G direction). Consequently, the magnetic toner staying near the protruding part 124 and the doctor blade 80 does not rise up or is not scattered.

In the developing apparatus of the present invention, as described above, a covering part covers the area from the magnetic plate to the opposing region. Even when a gap is caused between the developing agent controlling member and the magnetic plate, the covering part is above the formed gap. Therefore, this gap is affected by magnetic shielding, and rise or scattering of the developing agent is prevented. Thus scatter of the developing agent is prevented at the both lengthwise ends of the developingagent holder.

The covering part can be simply provided by forming a protrusion on the face portion of the magnetic plate opposing the developing agent controlling member.

The covering part, when placed at the upstream side of the developing agent controlling member in the rotation direction of the developing-agent holder, prevents more surely scatter of the developing agent at the lengthwise ends of the developing-agent holder.

The covering part, when placed at the downstream side of the developing-agent controlling member in the rotation direction of the developing-agent holder, prevents more surely scatter of the developing agent at the lengthwise ends of the developing-agent holder.

The covering part may be an elastic body, and may be made to serve to control the thickness of the developing agent by press-contact with the peripheral face of the developing-agent holder. The covering part may be made to cover the region ranging from the upstream side of the developing agent controlling member in the rotation direction of the developing-agent holder to the point of press-contact with the developing agent controlling member on the peripheral face of the developing-agent holder. In this case, scatter of the developing agent is more surely prevented at the lengthwise ends of the developing-agent holder.

In the case where the covering part is apart more from the peripheral face of developing-agent holder than the other portion of the magnetic plate, the magnetic brush can be formed without using excessive amount of the developing agent on the peripheral face controlled by the developing agent controlling member on the developing-agent holder. Thereby, the developing agent can be held in a suitable amount on the peripheral face, preventing sticking of the developing agent caused by rubbing of insufficient amount of the developing agent in the peripheral face.

In the case where the covering part has a slanting face which slants toward the inside of the developing-agent holder from the upstream side to the downstream side in the rotation direction of the developing-agent holder and along the peripheral face, the magnetic brush formed allows the developing agent to move inside the developing-agent holder (inside the developing apparatus). Thereby, scatter of the developing agent is more surely prevented at the lengthwise ends of the developing-agent holder.

The various reference numerals herein are as follows:

30 Copying machine
70 Developing apparatus
72 Developing sleeve
74 Magnet roller
80 Doctor blade
90, 100, 110, 120 Magnetic plate
92, 102, 112, 122 Base part
94, 104, 114, 124 Protruding part While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A developing apparatus comprising:

a developing-agent holder in a cylinder shape rotating in a prescribed direction for holding a developing-agent on the peripheral face thereof; a developing agent-controlling member extending in the length direction of the developing-agent holder in opposition thereto and controlling the developing-agent held on the peripheral face of the developing-agent holder to be in a prescribed thickness; and a magnetic plate extending in an arc shape along the peripheral face of the developing-agent holder in a region outside the lengthwise end of the developing agent-controlling member;

wherein said magnetic plate has a covering part for covering a portion of the peripheral face of the developing-agent holder in a range from the magnetic plate to the region opposing the developing agent-controlling member.

2. A developing apparatus, comprising:

a developing-agent holder in a cylinder shape rotating in a prescribed direction for holding a developing-agent on the peripheral face thereof; a developing agent-controlling member extending in the length direction of the developing-agent holder in opposition thereto and controlling the developing-agent held on the peripheral face of the developing-agent holder to be in a prescribed thickness; and a magnetic plate extending in an arc shape along the peripheral face of the developing-agent holder in a region outside the lengthwise end of the developing agent-controlling member; for developing a latent image by feeding a developing-agent from the developing-agent holder to an image bearing member bearing a latent image thereon, wherein said magnetic plate has a covering part for covering a portion of the peripheral face of the developing-agent holder in a range from the magnetic plate to the region opposing the developing agent-controlling member, wherein the covering part is a protruding part protruding on a portion of a face of the magnetic plate opposing the developing agent-controlling member.

3. The developing apparatus according to claim 2, wherein the covering part is placed at the upstream side of the developing agent-controlling member in the rotation direction of the developing-agent holder.

4. The developing apparatus according to claim 2, wherein the covering part is placed at the downstream side of the developing agent-controlling member in the rotation direction of the developing-agent holder.

5. The developing apparatus according to claim 2, wherein the developing agent-controlling member is an elastic body, serving to control the developing-agent to be in a prescribed thickness by pressure contact with the peripheral face of the developing-agent holder; and the covering part covers a portion of the developing-agent holder ranging from the upstream side of the developing agent-controlling member in the rotation direction of the developing-agent holder member to the region above the press contact of the peripheral face of the developing agent-controlling member with the developing-agent holder.

6. The developing apparatus according to any of claims 2 to 5, wherein the covering part is apart more from the peripheral face of the developing-agent holder than the other portion of the magnetic plate.

7. The developing apparatus according to any of claims 2 to 5, wherein the covering part has a slanting face which slants from the upstream side to the downstream side in the rotation direction of the developing-agent holder toward the inside of the developing-agent holder and along the peripheral face.

8. An image forming apparatus, employing the developing apparatus set forth in any of claims 2 to 5, for forming an image by developing an electrostatic latent image with the developing apparatus.

9. The developing apparatus according to claim 6, wherein the covering part has a slanting face which slants from the upstream side to the downstream side in the rotation direction of the developing-agent holder toward the inside of the developing-agent holder and along the peripheral face.

10. An image forming apparatus, employing the developing apparatus set forth in claim 6, for forming an image by developing an electrostatic latent image with the developing apparatus.

11. An image forming apparatus, employing the developing apparatus set forth in claim 7, for forming an image by developing an electrostatic latent image with the developing apparatus.

12. A developing apparatus comprising:

a developing-agent holder in a cylinder shape rotating in a prescribed direction for holding a developing-agent on the peripheral face thereof; a developing agent-controlling member extending in the length direction of the developing-agent holder in opposition thereto and controlling the developing-agent held on the peripheral face of the developing-agent holder to be in a prescribed thickness; and a magnetic plate extending in an arc shape along the peripheral face of the developing-agent holder in a region outside the lengthwise end of the developing agent-controlling member; for developing a latent image by feeding a developing-agent from the developing-agent holder to an image bearing member bearing a latent image thereon, wherein said magnetic plate has a covering part for covering a portion of the peripheral face of the developing-agent holder in a range from the magnetic plate to the region opposing the developing agent-controlling member, wherein the covering part is placed at the downstream side of the developing agent-controlling member in the rotation direction of the developing-agent holder.

13. The developing apparatus according to claim 1, wherein the covering part is placed at the upstream side of the developing agent-controlling member in the rotation direction of the developing-agent holder.

14. The developing apparatus according to claim 1, wherein the developing agent-controlling member is an elastic body, serving to control the developing-agent to be in a prescribed thickness by pressure contact with the peripheral face of the developing-agent holder; and the covering part covers a portion of the developing-agent holder ranging from the upstream side of the developing agent-controlling member in the rotation direction of the developing-agent holder member to the region above the press contact of the peripheral face of the developing agent-controlling member with the developing-agent holder.

15. The developing apparatus according to claim 1, wherein the covering part is apart more from the peripheral face of the developing-agent holder than the other portion of the magnetic plate.

16. The developing apparatus according to claim 1, wherein the covering part has a slanting face which slants from the upstream side to the downstream side in the rotation direction of the developing-agent holder toward the inside of the developing-agent holder and along the peripheral face.

17. An image forming apparatus, employing the developing apparatus set forth in claim 1, for forming an image by developing an electrostatic latent image with the developing apparatus.

* * * * *